US007128252B2

(12) United States Patent
Boenig et al.

(10) Patent No.: US 7,128,252 B2
(45) Date of Patent: Oct. 31, 2006

(54) SETTING DEVICE

(75) Inventors: Stefan Boenig, Achberg-Esseratsweiler (DE); Johann Buechel, Sevelen (CH); Michael Weibel, Wil (CH); Harald Fielitz, Lindau (DE)

(73) Assignee: Hilti Aktiengesellshaft, Schaan (LI)

( * ) Notice: Subject to any disclaimer, the term of this patent is extended or adjusted under 35 U.S.C. 154(b) by 0 days.

(21) Appl. No.: 10/935,656

(22) Filed: Sep. 7, 2004

(65) Prior Publication Data

US 2005/0051595 A1 Mar. 10, 2005

(30) Foreign Application Priority Data

Sep. 9, 2003 (DE) ..... 103 41 819

(51) Int. Cl.
*B25C 1/10* (2006.01)
*B25C 1/16* (2006.01)

(52) U.S. Cl. ..... 227/10; 227/9; 227/130

(58) Field of Classification Search ..... 227/8, 227/9, 10, 11, 48, 130; 173/121, 210, 212
See application file for complete search history.

(56) References Cited

U.S. PATENT DOCUMENTS 3,549,074 A * 12/1970 Brunelle ..... 227/10
3,820,703 A * 6/1974 Rangger ..... 227/10
4,374,567 A * 2/1983 Combette et al. ..... 227/10
5,048,740 A * 9/1991 Beton ..... 227/10
6,029,878 A * 2/2000 Pfister et al. ..... 227/10
6,039,229 A * 3/2000 Pfister et al. ..... 227/10
2004/0149801 A1* 8/2004 Hirtl et al. ..... 227/10

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

A setting device (10) drives fastening elements into a receiving material and includes a housing (11) with a piston guide (13) arranged in the housing (11) and with a hollow space (14) in which a setting piston (15) is displaceably mounted. A bolt guide (16) is connected to the piston guide (13) by an interface (17). The setting device further has a piston restoring device (20) with an adjusting member (21) which engages in the piston guide (13) in a work position and is moved out of the piston guide (13) into a release position (24). Further, there is a securing element (30), with the adjusting member (21) being held in the work position (23) in a first position (33) of the securing element (30) and the adjusting member (21) being released to move into the release position (24) in the second position (34) of the securing element (30).

8 Claims, 6 Drawing Sheets

SETTING DEVICE

BACKGROUND OF THE INVENTION

The present invention is directed to a setting device for driving fastening elements into a receiving material. Setting devices of this type can be operated with solid, gaseous or liquid fuels or also with compressed air. In combustion-operated setting tools, a setting piston is driven by means of the combustion gases. Fastening elements can then be driven into a receiving material by means of the setting piston.

After a setting operation, the piston in setting devices which is supported so as to be displaceable in a piston guide is generally pushed back into its starting position by a handle arranged on the device, e.g., a repeater handle. For this purpose, a resetting or restoring pin which projects into the piston guide acts in front of the piston head. The pin pushes the piston back when the handle is moved manually by the user. Frequently during the life of the device, this piston must be removed from the device for cleaning or when wear occurs at the piston.

A setting device of the kind mentioned above is known from the HILTI DX 750 combustion-operated setting device. In this device, a bolt guide is located with reference to the setting direction, in front of the piston guide, and must first be unscrewed from the piston guide before the piston can be removed from the device. For disassembly, it is further necessary to remove the pin or piston restoring element from the setting device because otherwise the piston would be blocked by the pin.

It is a disadvantage that the user is often not aware of the requirement to remove the pin or restoring element or finds it difficult.

It is known from the HILTI DX 351 setting device of the type mentioned above to arrange an adjusting sleeve for two piston restoring elements externally on the setting device, this adjusting sleeve being rotatable between two adjusting positions. In the first adjusting position, the piston restoring elements are held by the adjusting sleeve in their position in which they are moved into the piston guide, whereas, in the second adjusting position of the adjusting sleeve the piston restoring elements are moved by a spring element into a position in which they are moved out of the piston guide. In this moved out position, it is possible to pull the piston out of the piston guide after unscrewing the bolt guide.

In this case also, the user can easily overlook the step of moving the adjusting sleeve into the disassembly position, which results in complications when removing the piston.

SUMMARY OF THE INVENTION

It is the object of the present invention to develop a setting device of the type mentioned above which avoids the aforementioned disadvantages and in which the piston can be removed and changed in a simple and comfortable manner.

Accordingly, the securing element is movable translationally between its first position and its second position, wherein the securing element is held in its first position by the bolt guide occupying its assembled position, and wherein the securing element can be moved into the second position by displacing means by moving the bolt guide into its disassembly position. By means of this step, the securing element is automatically displaced along with the bolt guide when the latter is detached from the setting device, and the adjusting member is released and can move out of the piston guide. The user can now pull the piston out of the piston guide without further manipulation. This provides a very user-friendly, comfortable disassembly solution for a setting device.

It is advantageous when the displacing means comprise a spring element by which the securing element is spring-loaded in the direction of its second position. The securing element can follow the bolt guide in a technically simple manner by means of this spring element when removing the bolt guide from the setting device. Of course, a plurality of such spring elements can also be provided.

Further, the securing element could also be coupled directly to the bolt guide and, therefore, displaced along with it.

Reliable functioning is achieved in every position of the device by constructing the securing element as a sleeve part.

It is further advantageous when a stop is formed at the securing element, which stop contacts a counter-stop of the bolt guide in the mounted position of the bolt guide in the setting device. This step ensures that the securing element directly operates the assembled position of the bolt guide and follows the bolt guide when the latter is removed from the setting device.

It is likewise advantageous when a conical working surface is arranged at the adjusting member and can be moved by a counter-working surface at the securing element. The counter-working surface at the securing element can likewise be conical. By means of this step, the adjusting member can again be moved by the securing element and moved into the work position in the piston guide when the bolt guide is replaced at the setting device without additional manipulation on the part of the user.

Further, it can be advantageous when a spring element acts at the adjusting member and loads the adjusting member in the direction of its work position. This step ensures that the adjusting member always remains in its work position when the setting device is being operated. When the adjusting member has been released by the securing element, however, the adjusting member can be moved temporarily into its release position by the setting piston when the latter is pulled out of the setting device.

Alternatively, the adjusting member can also be acted upon by a spring element which loads the adjusting member in the direction of its release position. In this way, the adjusting member is automatically moved into its release position when the securing element releases the adjusting member. In its second position or securing position, the securing element then holds the adjusting member in its work position.

It is further advantageous when a lock element is arranged at the adjusting member, and the lock element can be inserted into a lock receptacle at the piston guide for locking the adjusting member in its work position. By means of this step, the adjusting member is held in a defined position when the bolt guide is replaced at the piston guide on one hand and is held without force with respect to the securing element on the other hand.

BRIEF DESCRIPTION OF THE INVENTION

The invention is shown in two embodiment examples in the drawings.

DETAILED DESCRIPTION OF THE INVENTION

Figure 1:
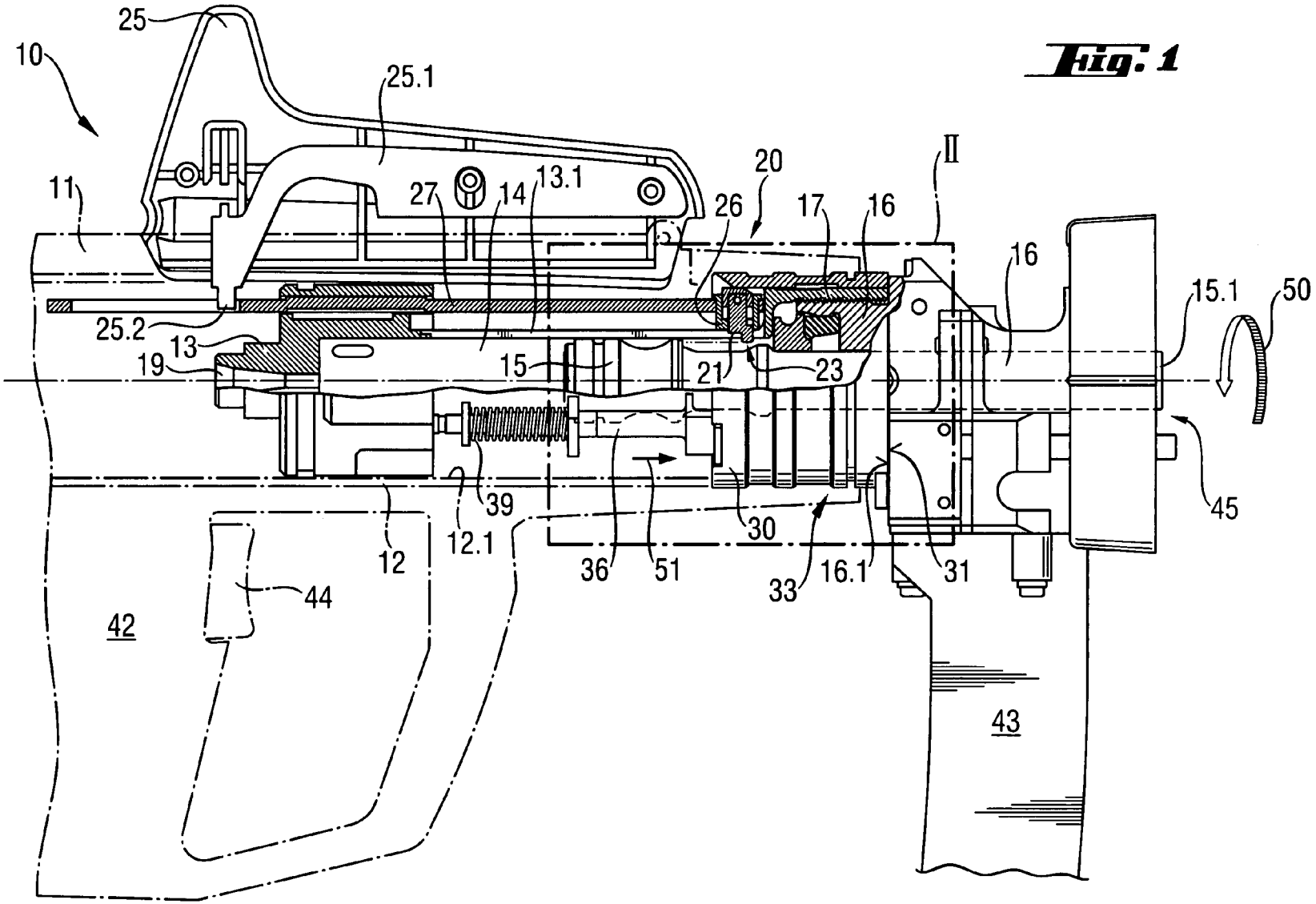
FIG. 1 is a schematic side view of a setting device according to the invention in partial section.

Identical reference numbers are used for identical elements in the following description.

A setting device 10 has an axially extending piston guide 13 which is arranged in a housing 11 comprising one or more parts. An axially extending setting piston 15 is displaceably arranged in a hollow space 14 of the piston guide 13 and can be driven by a propellant or by reaction products thereof. In the present example, a cartridge holder 19 is arranged at a trailing end of the piston guide 13 for receiving a propellant charge. In the present embodiment, the piston guide 13 is mounted in the housing 11 so as to be displaceable in a receptacle 12.1 of a sleeve part 12 and is resiliently supported against the housing 11 by means of a spring element, not shown. However, a setting process with the setting device 10 is only possible when the mouth 45 of the setting device 10 is pressed against a receiving material and a trigger 44 at a handle 42 of the setting device 10 is actuated.

A bolt guide 16 which is connected to the piston guide 13 by an interface 17 formed, for example, as a screw thread arranged at the end of the piston guide 13 remote from the cartridge holder 19. In this embodiment example, a magazine 43 for fastening elements is secured to the bolt guide 16.

A piston restoring device 20 comprising a slide element 27 located between the piston guide 13 and the sleeve part 12.1 is arranged in the setting device 10. An adjusting member 21 is arranged in a receptacle 26 at the end of the slide element 27 situated in the direction of the mouth 45 of the setting device 10. This adjusting member 21 projects through a cutout 13.1 in the piston guide 13 by its member or pin 21.1 in its work position 23 shown in FIGS. 1 and 2 and projects through the piston guide 13 into the hollow space 14. The adjusting member 21 is fixedly connected to a cap part 21.4 at which there is a conical working surface 21.2 that is inclined inwardly in the direction of the mouth 45 of the setting device 10. A spring element 29 is arranged between this cap part 21.4 and the receptacle 26. The adjusting member 21 is acted upon resiliently by the spring element 29 in the direction of its release position 24 (see FIG. 3) in which it is moved out of the hollow space 14.

The adjusting member 21 of the piston restoring element 20 can be moved by the user by means of an actuating element 25 which is constructed as a handle or repeater handle and which is displaceably guided at the housing 11, and the setting piston 15 is accordingly moved back out of its end position near the mouth into its forward end position at the cartridge holder 19 after a setting process has been completed. The actuating element 25 is coupled to the slide element 27 by means of a transmission member 25.1 and its driver part 25.2. In the present embodiment, the setting piston 15 has a piston collar 15.2 at its piston shank 15.1. The pin 21.1 engages behind the piston collar 15.2 in order to move the setting piston 15 by means of the piston restoring device 20.

Further, another securing element 30, constructed as a sleeve part, is supported at the piston guide 13 by means of spring elements 39 and intermediate members 36 arranged in the setting device 10. The securing element 30 is displaceable axially and coaxially relative to the piston guide 13 between a first position 33 (FIGS. 1 and 2) and a second position 34 (FIG. 3). In the first position 33 of the securing element 30 shown in FIGS. 1 and 2, the bolt guide 16 contacts the stop 31 of the securing element 30 by its stop 16.1. The adjusting member 21 is moved by the securing element 30 and is held against the force of the spring elements 29 in its work position 23 in which the pin 21.1 lies in the axial projection of the piston collar 15.2.

Figure 2:
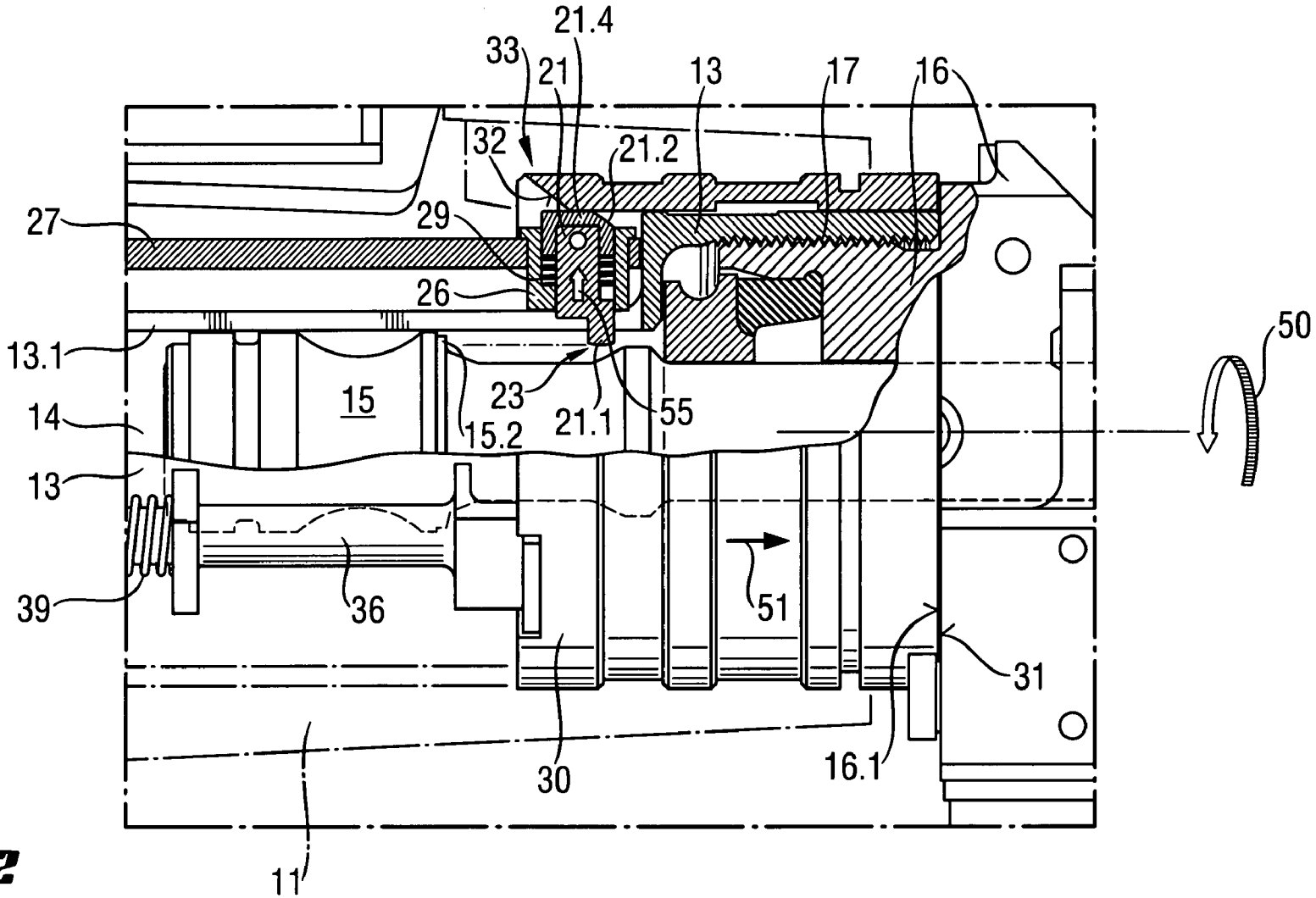
FIG. 2 is a schematic view of a detail of the setting device shown in section II of FIG. 1 and in partial section.
Figure 3:
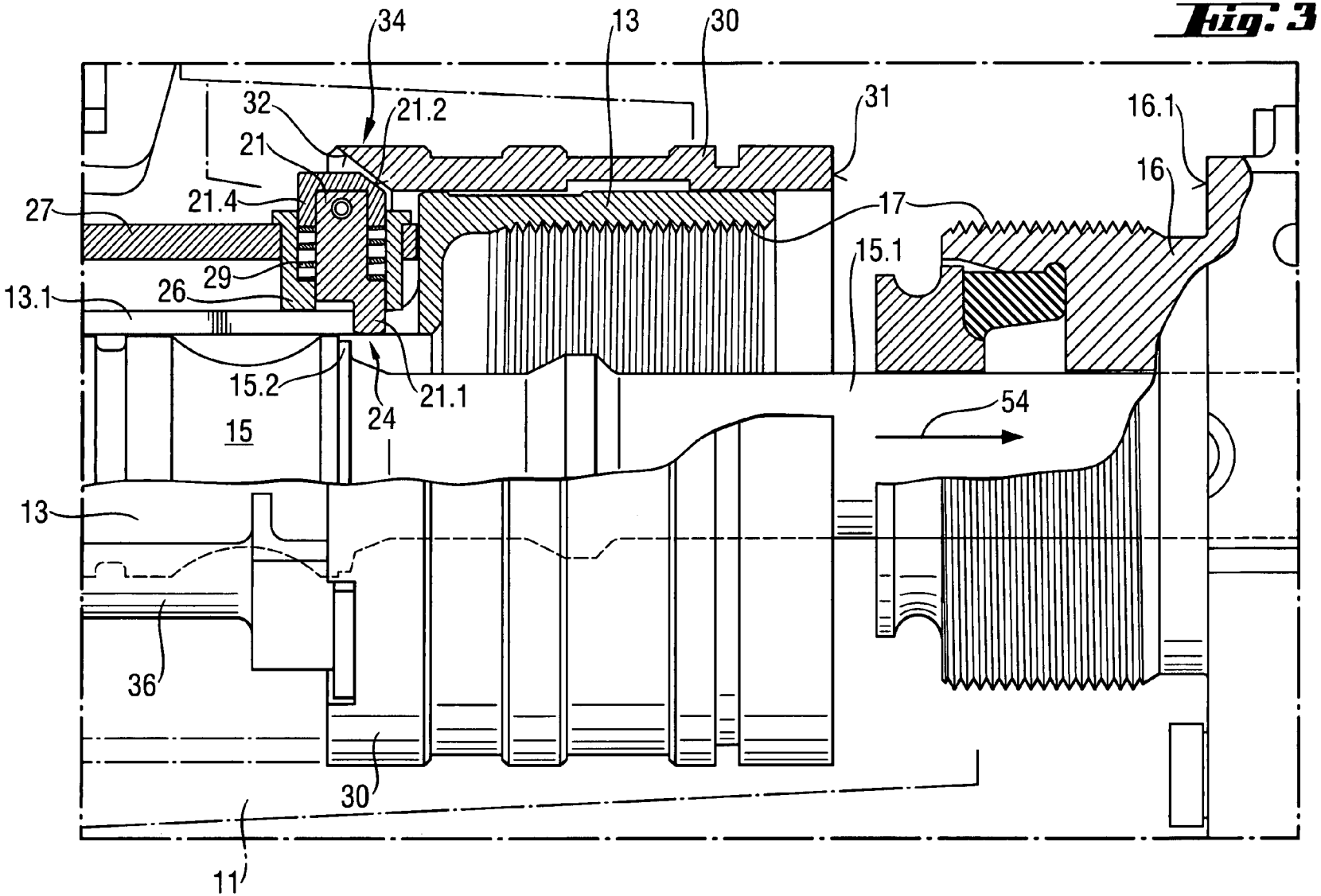
FIG. 3 is a schematic view in partial section showing the detail of the setting device from FIG. 2 with the bolt guide unscrewed.

When the bolt guide 16 is unscrewed from the piston guide 13 in the rotating direction indicated by arrow 50, the securing element 30 follows the bolt guide 16 accompanied by the force of the spring elements 39 and is moved axially in the direction of arrow 51 (see FIGS. 1 and 2). The adjusting member 21 can be moved by the force of the spring elements 29 in the direction of arrow 55 (FIG. 2) into its release position 24 (FIG. 3) in which it is drawn out of the hollow space 14 as soon as the securing element 30 has been moved into its second position 34 (see FIG. 3). The setting piston 15 can now be pulled out of the piston guide 13 in the direction of arrow 54. In order to facilitate reassembly of the setting device 10, a counter-working location 32 which complements the working surface 21.2 of the adjusting member 21 and which is formed as a conical surface in the present instance is arranged at the securing element 30. The two conical working surfaces facilitate the movement of the adjusting member 21 and the penetration of the adjusting member 21 with pin 21.1 into the hollow space 14 when the securing element 30 is moved from the second position 34 into the first position 33 by screwing the bolt guide 16 into the piston guide 13.

Figure 4:
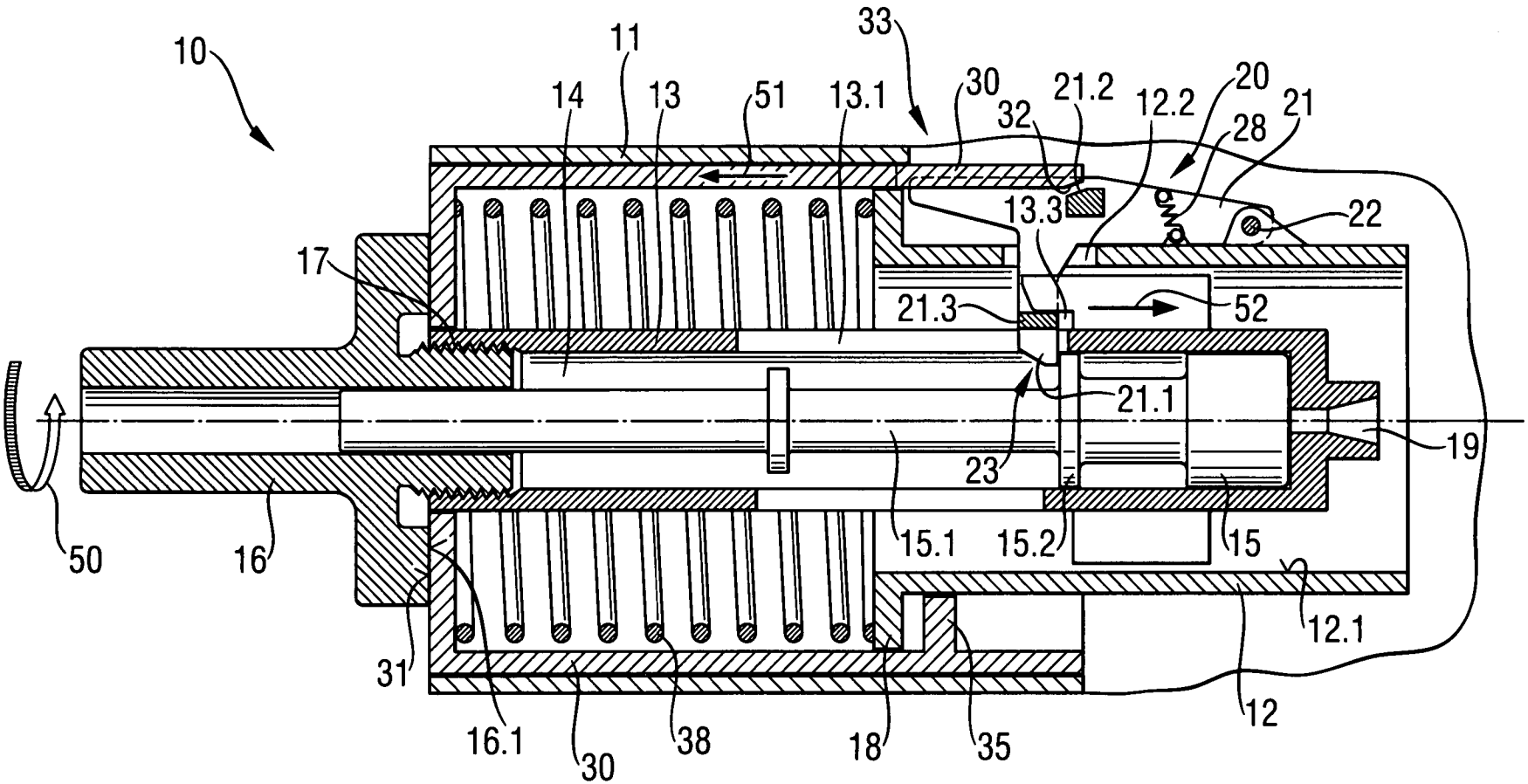
FIG. 4 is a schematic view in axial section through a portion of another setting device according to the invention.
Figure 5:
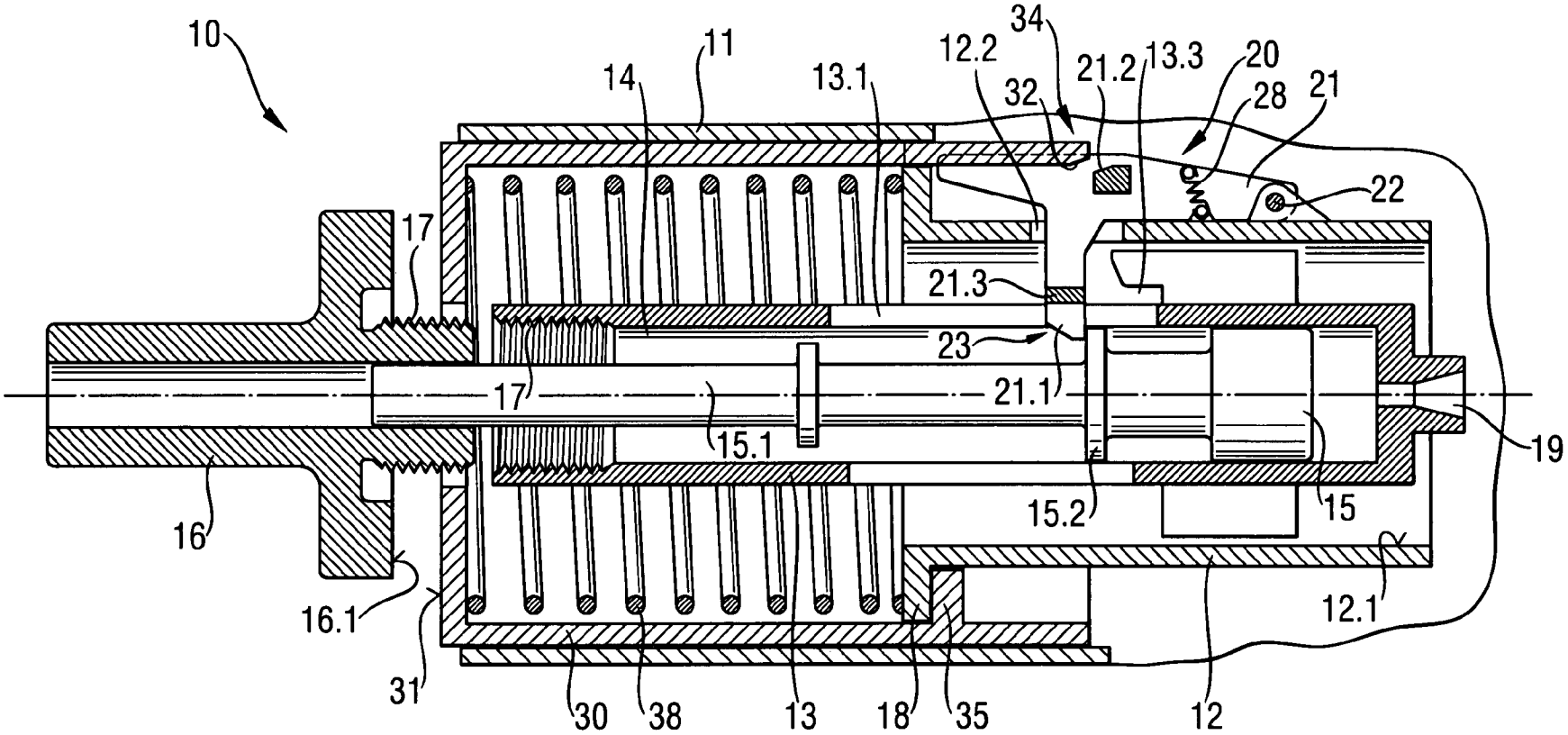
FIG. 5 is a schematic view of the setting device from FIG. 4 with a loosened bolt guide.
Figure 6:
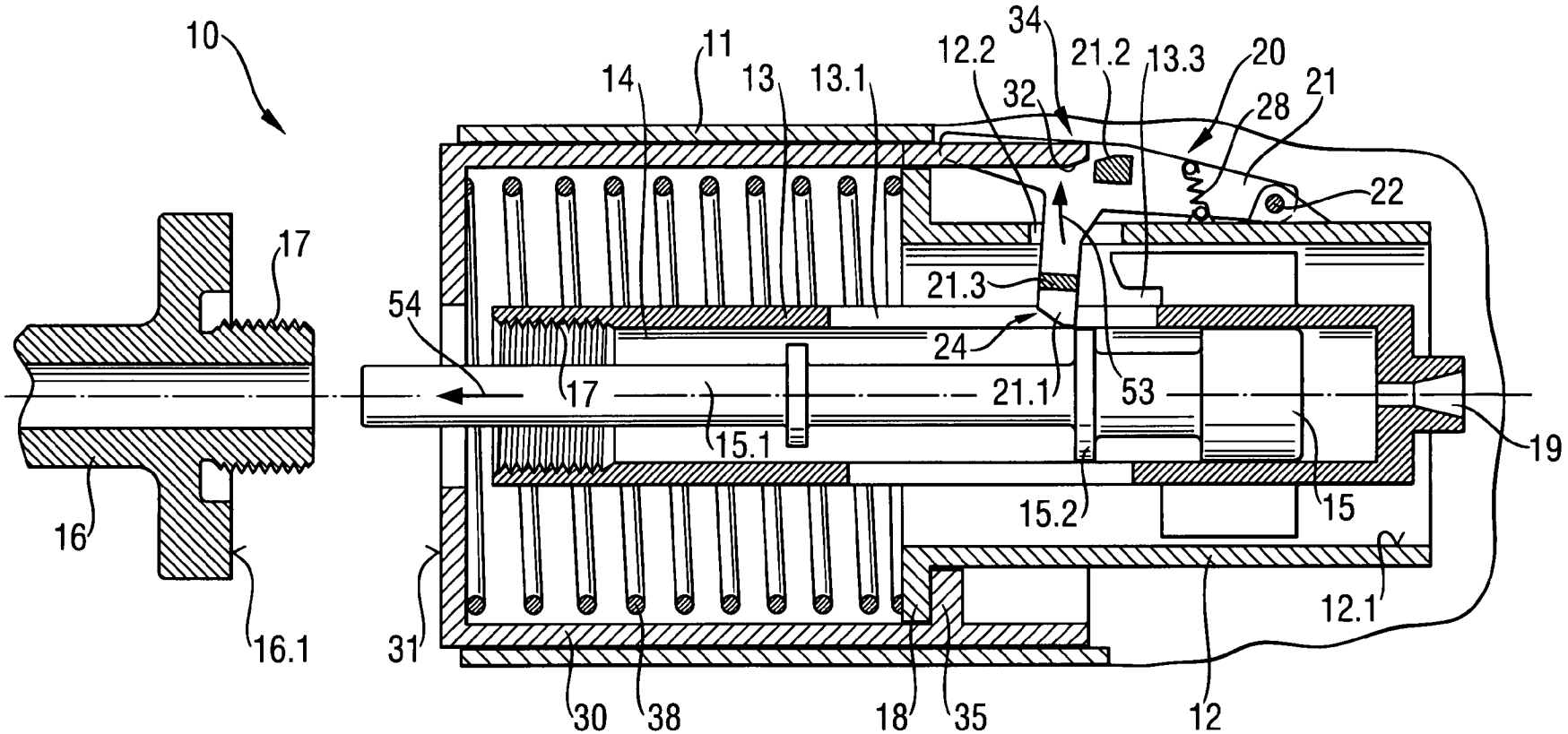
FIG. 6 is a schematic view of the setting device from FIG. 4 with a detached bolt guide.

Another embodiment example of a combustion-operated, hand-held setting device 10 is shown in FIGS. 4 to 6. The rear portion of the setting device with the handle has been omitted from the drawing. In this respect and because of reference numbers not explicitly mentioned, reference is had to the preceding description of FIGS. 1 to 3 in its entirety.

The setting device 10 shown here in its initial position again has a piston guide 13 which is guided in the receptacle 12.1 of the sleeve 12, the setting piston 15 being displaceably guided in the hollow space 14 of this piston guide 13. The bolt guide 16 adjoins the piston guide 13, again so as to extend coaxially, at the side of the piston guide 13 remote from the cartridge holder 19. The interface 17 between the piston guide 13 and the bolt guide 16 is again constructed in this instance as a screw thread. In the assembled position of the bolt guide 16 shown in FIG. 4 in which it is mounted at the setting device 10, the bolt guide 16 contacts the stop 31 of the securing element 30 by its counter-stop 16.1. The securing element 30 is likewise constructed as a sleeve part in this second embodiment. At least one other stop 35 cooperates with a collar 18 at the sleeve part 12, in a manner to be described hereinafter, is arranged at the securing element 30.

At least one spring element 38 by which the securing element 30 is acted upon resiliently in the direction of the bolt guide 16 is arranged between the securing element 30 and the sleeve part 12. The sleeve part 12 is substantially fixedly connected to the housing 11.

In the present example, the piston restoring device 20 has an adjusting member 21 which is constructed as a swivelable catch. The adjusting member 21 is arranged at a swivel bearing 22 on the sleeve part 12. The adjusting member 21 further has a member or pin 21.1 which engages in the hollow space 14 through the cutout 12.2 in the sleeve part 12 and the cutout 13.1 in the piston guide 13 in the work position 23 of the adjusting member 21 shown in FIG. 4 and lies behind the piston collar 15.2 of the piston shank 15.1 in the hollow space 14. The adjusting member 21 is acted upon resiliently in the direction of its work position 23 by a spring element 28. In the present initial position of the setting device 10, the adjusting member 21 is likewise held by means of a lock element 21.3 which engages in a lock receptacle 13.3 at the piston guide 13. When the piston guide 13 is moved into the setting device 10 relative to the sleeve part 12, e.g., when the setting device 10 is pressed against a receiving material, the lock element 21.3 is released by the lock receptacle.

In the position of the setting device 10 shown in FIG. 1, the adjusting member 21 is prevented from swiveling out of the hollow space 14 by the securing element 30 because the securing element 30 covers a conical working surface 21.2 at the adjusting member 21 in its first position 33 by its counter-working location 32.

The restoring of the piston by means of the piston restoring device 20 described herein is effected when the setting device 10 is lifted from a receiving material after completed setting by means of the piston guide 13 moving out of the sleeve part 12, the setting piston 15 being fixed relative to the piston guide 13 by the pin 21.1 of the adjusting member 21.

In order to remove the setting piston 15 from the setting device 10, the bolt guide 16 must first be unscrewed from the piston guide 13 in the rotating direction indicated by arrow 50. In this way, on the one hand, the securing element 30 is displaced in the direction indicated by arrow 51 relative to the sleeve part 12 with the adjusting member 21 by means of the spring element 38, so that the securing element 30 is moved into its second position 34 shown in FIGS. 5 and 6. In this second position 34, the counter-working location 32 releases the conical working surface 21.2 and the stop 35 of the securing element 30 contacts the collar 18 of the sleeve part 12 (see FIG. 5). On the other hand, the piston guide 13 is moved into the sleeve element 12 relative to the bolt guide 13 in direction of arrow 52. This can be carried out by the action of a spring element, not shown, or by gravitational force when the setting device 10 is disassembled with the bolt guide 13 at top.

Accordingly, the lock element 21.3 is also released from the lock receptacle 13.3 of the piston guide 13 as can be seen from FIG. 5. When the bolt guide 16 is removed from the setting device 10 and the setting piston 15 is pulled out of the piston guide 13 in the direction indicated by arrow 54, the adjusting member 21 is swiveled over the piston collar 15.2 against the force of the spring element 28 in the direction of arrow 53 and is moved temporarily into its release position 24 as is shown in FIG. 6.

When the setting piston 15 is inserted into the setting device 10 again, it can also lift the adjusting member 21 in the insertion direction again over its piston collar 15.2. When the bolt guide 16 is screwed into the piston guide 13 at the interface 17, the piston guide 13 is first pulled toward the bolt guide 16 again so that the lock element 21.3 of the adjusting member 21 is again received in the lock receptacle 13.3 of the piston guide 13. The securing element 30 is again displaced from its second position 34 (FIGS. 5 and 6) into its first position 33 (FIG. 4) in which the securing element 30 prevents the adjusting member 21 from moving into its release position 24.

The invention claimed is:

1. Setting device for driving fastening elements into a receiving material comprises a housing (11) containing an axially elongated piston guide (13) having a leading end and a trailing end and forming an axially extending hollow space (14) between the leading and trailing end, an axially extending setting piston (15) is displaceably mounted in said hollow space, a bolt guide (16) connected to the leading end of said piston guide (13) at an interface (17), a piston restoring device (20) containing an adjusting member (21) engageable in said piston guide (13) in a work position (23) and displaceable from said piston guide (12) transversely of the axial direction of said piston guide into a release position (24), a securing element (30) supported on the leading end of said piston guide (13), said adjusting member (21) being held in the work position (23) in a first position (33) of said securing element (30) and said adjusting member (21) being released for displacement linearly into said release position (24) in a second position (34) of said securing element (30) is displaced axially between the first position (33) and the second position 34 with said securing element (30) held in its first position (33) by said bolt guide (16) in an assembled position thereof and said securing element (30) can be displaced into the second position (34) by displacing means when said bolt guide (16) is displaced into the second position (34) by displacing means when said bolt guide (16) is displaced axially out of the leading end of said piston guide into a disassembled position.

2. Setting device, as set forth in claim 1, wherein said displacing means comprises a spring element (38, 39) spring loading said securing element (30) radially outwardly in the direction of the second position (34).

3. Setting device, as set forth in claim 1, wherein said securing element (30) is a sleeve part.

4. Setting device, as set forth in claim 1, wherein a stop (31) is formed on said securing element (30), said stop (31) contacts a counter stop (16.1) on said bolt guide (16) in the assembled position of said bolt guide (16) in which said bolt guide is mounted in the setting device (10).

5. Setting device, as set forth in claim 1, wherein said adjusting member (21) hasd a conical working surface (21.2) which can be displaced, relative to a counter acting conical surface (32) on said securing element (30).

6. Setting device, as set forth in claim 1, wherein a spring element (28) acts at said adjusting member (21) and biases said adjusting member (21 radially inwardly in the direction of its work position (23).

7. Setting device, as set forth in claim 1, wherein a spring element (29) acts on said adjusting member (21) and biases said adjusting member (21) in the direction of said release position (24).

8. Setting device, as set forth in claim 1, wherein a lock element (21.3) is formed at said adjusting member (21) and is insertable into a lock receptacle (13.3) in the piston guide (13) for locking said adjusting member (21) in its work position (23).

* * * * *